US005396865A

United States Patent [19]

Freeh

[11] Patent Number: 5,396,865

[45] Date of Patent: Mar. 14, 1995

[54] STARTUP SYSTEM FOR POWER PLANTS

[76] Inventor: James H. Freeh, 13329 Oakwood Dr., Rockville, Md. 20850

[21] Appl. No.: 251,913

[22] Filed: Jun. 1, 1994

[51] Int. Cl.[6] ..... F22D 7/00

[52] U.S. Cl. ..... 122/406.5; 122/406.4

[58] Field of Search ..... 122/404.4, 404.5

[56] References Cited

U.S. PATENT DOCUMENTS

| | | | |
|---|---|---|---|
| 3,199,494 | 8/1965 | Strohmeyer, Jr. | 122/406.4 |
| 3,243,961 | 4/1966 | Carachristi | 122/406.4 |
| 3,255,735 | 6/1966 | Pacault et al. | 122/406.4 |
| 3,292,372 | 12/1966 | Michel | 122/406.4 |
| 3,358,450 | 12/1967 | Schroedter et al. | 122/406.5 X |
| 3,467,067 | 9/1969 | Clayton, Jr. | 122/406.4 |
| 4,703,722 | 11/1987 | Fukayama | 122/406.5 |
| 4,790,269 | 12/1988 | Hamill et al. | 122/406.5 |
| 4,915,062 | 4/1990 | Dolezal | 122/406.5 |

FOREIGN PATENT DOCUMENTS 1030352 5/1966 United Kingdom ..... 122/406.4

*Primary Examiner*—Edward G. Favors
*Attorney, Agent, or Firm*—Ronald B. Sherer

[57] ABSTRACT

A startup system for a steam-driven turbine type power plant is disclosed in which auxiliary steam from an external source is heat exchanged against a circulating fluid so as to supply heat to the main steam generator during startup. In one preferred embodiment, auxiliary steam is also used to heat an inert gas which is circulated through the main superheater or reheater of the power plant to heat the superheater or reheater during startup. In another preferred embodiment, steam from a main superheater, or reheater, is used to heat a fluid in an auxiliary generator, and the heated fluid in the auxiliary generator is circulated to supply additional heat to the main steam generator during startup.

12 Claims, 1 Drawing Sheet

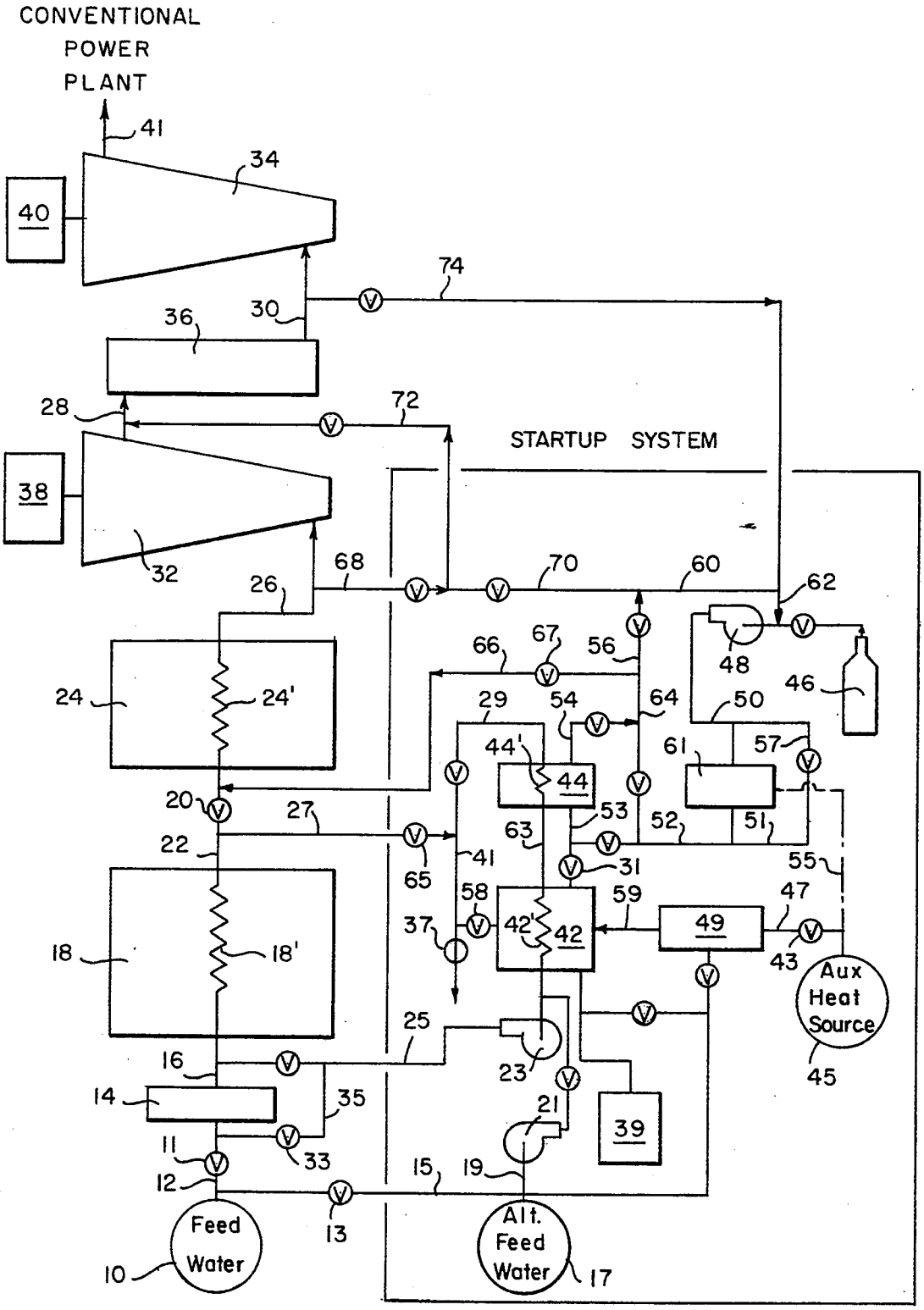
CONVENTIONAL
POWER
PLANT
STARTUP SYSTEM
Feed
Water
Alt.
Feed
Water
Aux
Heat
Source

STARTUP SYSTEM FOR POWER PLANTS

This invention relates to steam-turbine power plants for generating electricity, and more particularly to auxiliary startup systems for bringing the power plant up to operating temperature more economically and with reduced pollutants to the atmosphere.

BACKGROUND

Steam-turbine type power plants require large fossil-fired steam generators for producing the steam to be expanded in the turbines which drive the electrical generators. In addition, such plants require superheaters, piping and valves all of which components must be brought up to suitable temperatures, or at least a minimum temperature, before the turbines can be started. In conventional steam-turbine power plants, the heat required for startup in order to reach the minimum temperature is supplied by the main steam generator. This is accomplished by operating the main steam generator, in a startup mode to be further described, and utilizing the heat of the steam by passing it through the superheater, main steam lines and then to a condenser.

This method of startup has several severe disadvantages such as, for example, the fact that the steam gives up more heat to the condenser than to the steam piping which constitutes a significant waste of energy. Also, the various components of the power plant are not heated to individually ideal temperatures.

In addition to being wasteful and inefficient, the use of the main steam generator to provide the heat of startup produces significantly increased production rates of nitrogen oxide on a pound per BTU basis. That is, nitrogen oxide production rates are substantially higher than those produced during normal, steady-state operation of the power plant. This is caused by the fact that the firing rate of the main generator during startup must be held relatively low so as not to exceed temperature limits of the metals, or rates of temperature change, or maximum temperature differentials of the components. However, safety considerations require that the flow of combustion air must be at least twenty-five percent of full load flow any time that the furnace is fired. Thus, during startup conditions, there is an excessive amount of oxygen in the oxygen-fuel ratio, and the presence of such excessive amounts of oxygen above the stoichiometric amount results in significantly increased amounts of nitrogen oxides being produced.

For these and other reasons which will become apparent, there has long been a need for a method of starting up power plants more efficiently and with reduced production of nitrogen oxides. The present invention solves this need as will become apparent from the following description of one preferred embodiment of the invention as illustrated in the accompanying drawing.

BRIEF DESCRIPTION OF DRAWING

FIG. 1 schematically illustrates one embodiment of the startup system of the present invention as applied to a power plant.

DETAILED DESCRIPTION

Referring to FIG. 1, the main components of a typical, once-through type of steam-turbine power plant are illustrated on the left, while the components forming the startup system of the present invention are shown on the right as they would be connected to the typical plant.

Referring first to the power plant, it will be understood that in normal operation of the plant, feed water from source 10 flows through line 12 to an economizer 14, and through line 16 to main steam generator 18 where conventional fuel-fired burners (not shown) convert the water to steam in tube banks schematically illustrated at 18'. From tube banks 18' the steam passes through line 22 and valve 20 to superheater 24 where the steam is further heated in the tube banks 24' before being supplied through lines 26, 28 and 30 to high pressure turbine 32 and intermediate pressure turbine 34. A conventional reheater 36 is provided between turbines 32 and 34, and it will be understood that a low pressure turbine (not shown) may also be part of the power plant. Turbines 32 and 34 are connected to drive electrical generators 38 and 40, respectively, whereby electrical power is generated, and the steam is then sent to the low pressure turbine through line 41. Of course, it will be understood that typical power plants include many other components, but only those main components involved in startup operation are illustrated. It will also be understood that, in commercial practice, the individually illustrated components comprising economizer 14, main generator 18, superheater 24 and reheater 36 are normally located within a common housing, which housing also includes conventional, fuel-fired burners not illustrated.

Referring now to the startup system, the main components of the system will be described first, followed by a description of the operation of the system in starting up the power plant. The source of heat for the startup system is provided by one or more external heat sources indicated by numeral 45. For example, where multiple power plant trains are operating at a site, a side stream of steam from an adjacent train may be employed. Alternatively, exhaust gas from an on-site gas turbine may be used to generate auxiliary steam, or a small fired-boiler may be dedicated for startup use only, or other sources of steam such as from an adjacent combined cycle unit may be employed. Thus, auxiliary steam is supplied from such auxiliary source 45 through valve 43, line 47, an atemperator 49 and line 51 to heat auxiliary generator 42; auxiliary generator 42 being essentially a heat exchanger in which the auxiliary steam from source 45 produces high temperature water in tube banks 42'. In this manner, the auxiliary generator 42 is brought up to the desired temperature very efficiently, since the steam from source 45 is being produced very efficiently, with little pollution, and may even be a waste stream. The shell side of generator 42 is connected through valve 31 and line 53 to the shell side of a superheater 44 for reasons which will be subsequently described.

In addition to the factors of efficiency and pollution reduction, much of the tubing in conventional superheaters and reheaters is not drainable such that, if the steam used for preheating the power plant during startup condenses in these tubes, a residue may be left when the condensed water is subsequently vaporized during normal plant operation. If this process of condensation and vaporization is repeated during each startup cycle, a significant amount of residue buildup may occur which adversely affects the heat transfer rate of the tubes, and may also lead to premature tube failure. The present invention solves this problem by providing for the use of an inert gas as the heating fluid for certain parts of the power plant during relatively low temperature startup conditions.

Referring to FIG. 1, numeral 46 represents a source of an inert gas, such as nitrogen for example, which may be provided in high pressure cylinders or tube trailers or the like. The gas may be circulated by a circulation blower 48 through line 49 to an auxiliary heater 61 which heats the gas to the desired temperature. Heater 61 may be any one of many types such as an indirect heater in which the inert gas is heated in tube banks by burners or by steam from any other auxiliary source. For example, steam from auxiliary source 45 may be used for all or part of the heating in heater 61, and hence, phantom line 55 indicates this possible connection.

The heated, inert gas may be circulated from heater 61 to the shell side of auxiliary superheater 44 through lines 52 and 53, and returned to blower 48 through lines 54, 64, 56, 60 and 62. In order to heat main superheater 24, the heated gas may be circulated through lines 52, 64 and 66 to superheater 24, and may be returned through lies 26, 68, 70, 60 and 62. Similarly, the heated gas may be circulated to reheater 36 from superheater 24 through lines 26, 68, 72 and 28, and returned to blower 48 through lines 74 and 62.

OPERATION

When it is desired to startup the conventional power plant from a cold start, valve 11 is maintained closed so that feed water does not flow into the plant until the plant has reached the desired startup temperature and the other conditions for through flow have been established. While it will be understood that various sequences of startup operation are possible, one of the first steps is to establish circulation under pressure in the main steam generator circuit by operating pumps 21, 23 and circulating water from auxiliary feed water source 17 through lines 19 and 25, and optimally through line 35 to economizer 14, and then to main steam generator 18, and return to pump 23 through lines 22, 27, 29 to superheater 44 and through line 63 and generator 42 to pump 23. Thereafter, valve 43 may be opened to admit auxiliary steam to flow through line 47, atemperator 49 and line 51 to auxiliary generator 42. The auxiliary steam heats the water circulating through exchanger tubes 42' such that hot water is produced in the auxiliary generator. This hot water is circulated through pump 23 to main steam generator 18 as previously described. After heating the shell side of auxiliary generator 42, the cooled water passes to condenser 39.

As heating of main steam generator 18 continues, high pressure can be relieved from the recirculation circuit through either valve 58 or 37. Low pressure can be corrected by operating pressurizing pump 21, and blowdown for water chemistry control can be effected through either valve 37 or 58.

While main generator 18, and economizer 14 if desired, are being heated by auxiliary generator 42, superheater 24 and reheater 36 may be heated by the inert gas heated in auxiliary heater 61 and circulated by circulation blower 48 as previously described. After the superheater and reheater have reached a minimum temperature at which steam will not condense and leave a residue as previously described, the flow of inert gas may be vented or stored as desired. Then, steam provided by auxiliary steam source 45 flows through lines 47, 51, generator 42, valve 31, line 53, superheater 44, lines 54 and 66 to superheater 24 and reheater 36 through the circuit previously described with respect to the circulation of the inert gas.

After all of the components of the conventional power plant have been brought to maximum practical temperatures depending upon the temperature and pressure conditions of the auxiliary steam source, the burners in the main steam generator 18 may be fired. In general, this should be delayed until turbine roll has either begun or is imminent. When main steam generator 18 is fired, safety considerations require that there must be at least 25% of full load water flow through the tube banks, but wet steam cannot be sent to the superheater due to the condensation problem previously explained. Therefore, in conventional practice, hot water must be separated from the steam in a separator, and the hot water is sent to a deaerator or condenser. Thus, there are substantial power losses in pumping and separating the fluids as well as the heat losses in the condenser. However, in the present invention, the heat in the recirculating fluid is efficiently utilized by passing it through lines 27 and 29 to supply heat to tube bank 44' of auxiliary superheater 44 and tube bank 42' of auxiliary generator 42. This heat in the tube banks heats the fluid on the shell side of these exchangers, and the heated fluid in the shell side may be sent through lines 54 and 66 to further heat main superheater 24 and reheater 36 through the previously described circuit. Thus, the pumping power requirements are quite small and there is no heat loss to the condenser. As previously stated, economizer 14, main steam generator 18, superheater 24 and reheater 36 are normally located within a single housing in conventional practice, which housing also contains the burners. Therefore, when the burners are fired to heat the main steam generator and superheater during startup, there is a danger of overheating the reheater which normally has little or no fluid flow through it at this time. However, in the present invention, the circulation of steam, further heated as just described, maintains a fluid flow through the reheater and maintains the temperature thereof in a non-overheated condition.

As the burners continue to fire, superheater 24 and reheater 36 become further heated, and this additional heat is transferred to the fluid flow through the tube banks of these units. This flow leaves the power plant system primarily through line 74, although a portion may be directed through line 68 depending upon the temperature and required flow conditions. In either event, this hot fluid is returned to blower 48 through line 62. This hot fluid may then be sent through line 50, heater-bypass line 57, and lines 51, 52 and 53 to the shell side of auxiliary superheater 44 to supply further heat to the startup system. Thus, the heat in the fluid leaving the reheater may be used to heat the water in the recirculation circuit thereby shortening the time and reducing the amount of fuel required by the burners during startup.

In most startup situations, the startup system will continue to supply heat, and distribute the heat as just described, until turbine roll is achieved. The turbines may be rolled initially on the steam from superheater 24 before feed water from source 10 is admitted through valve 11. When conditions are such at the outlet of main steam generator 18 that dry steam can be delivered directly to the superheater inlet, through-flow through the main steam generator can be initiated. When through-flow, larger than can be supplied by pump 21 is desired, the conventional feedwater supply system 10 and controls are placed in operation and valve 11 is opened. When through-flow is large enough to satisfy design requirements for the main steam generator cooling, the startup system can be either isolated or maintained in a hot standby condition. This may be accomplished in an energy efficient manner while maintaining multiple desired temperatures in the various components of both the startup system and the power plant.

From the foregoing description it will be apparent that the startup system provides a highly efficient source of heat which minimizes power losses and operates in a non-polluting manner so as to bring the power plant up to operating temperature at which it can operate efficiently and with low levels of nitrogen oxides. In addition, in the preferred embodiment, an inert gas system is used to preheat the main superheater and reheater before dry steam is admitted to further heat these units. However, it will be understood that the present invention may be operated without the inert gas system, if so desired, while still achieving a substantial increase in efficiency and achieving a substantial reduction in the production of nitrogen oxides. It will also be apparent that the startup system as described and shown in the accompanying drawing may be operated in numerous variations, depending upon the operation of the various valves, whereby each major component of the power plant may be heated in customized conditions which best suit the particular circumstances of a given power plant. Also, the present invention is equally applicable to the startup of drum-type power plants as well as the once-through type illustrated. Accordingly, it will be understood that the foregoing description is intended to be purely illustrative of the principles of the invention, and that the invention is not to be limited other than as set forth in the following claims.

What is claimed is:

1. A startup system for a power plant, said power plant including a main steam generator, comprising:

a source of auxiliary heat, an auxiliary generator for producing a hot fluid from said auxiliary heat, and passage means for passing said hot fluid from said auxiliary generator to said main steam generator during startup of said power plant.

2. The startup system of claim 1 wherein said source of auxiliary heat comprises a source of steam, and passage means for passing steam from said source to said auxiliary generator to produce said hot fluid in said auxiliary generator.

3. The startup system of claim 1 wherein said power plant includes a superheater, and passage means for passing steam from said auxiliary generator to said superheater after said superheater has reached a predetermined temperature.

4. A startup system for a power plant, said power plant including a superheater, said startup system including a source of inert gas, said startup system including heater means for heating said inert gas, and passage means for passing said heated inert gas to said superheater to heat said superheater during startup.

5. The startup system of claim 4 wherein:

said power plant includes a reheater, and passage means for passing said heated inert gas to said reheater to preheat said reheater.

6. The startup system of claim 5 wherein said startup system includes an auxiliary generator, and passage means for passing steam from said auxiliary generator to said reheater after said reheater has been preheated by said heated inert gas.

7. The startup system of claim 1 where said startup system includes an auxiliary superheater, and passage means connecting said auxiliary superheater to said auxiliary generator.

8. The startup system of claim 7 wherein:

said startup system includes a source of inert gas and means for heating said gas, and passage means for passing said heated inert gas to said superheater to preheat said auxiliary superheater.

9. A startup system for a power plant, said power plant including a superheater and main steam generator, said main steam generator producing a hot fluid during startup of said power plant, said startup system including an auxiliary generator comprising a heat exchanger having a tube-side, a shell-side and a fluid in said shell-side, passage means for passing said hot fluid from said main steam generator to the tube-side of said heat exchanger during startup and thereby heating said fluid in the shell-side of said exchanger, and passage means for passing said heated fluid from the shell-side of said exchanger to said superheater during startup.

10. The startup system of claim 9 wherein said power plant further includes a reheater, and passage means for passing said heated fluid to said reheater during startup.

11. A startup system for a power plant, said power plant including a main steam generator and a main superheater connected to said main steam generator, said startup system including an auxiliary generator and an auxiliary superheater connected to said auxiliary generator, passage means for passing steam from said main superheater during startup to said auxiliary superheater to heat a fluid in said auxiliary superheater, and passage means for passing said heated fluid from said auxiliary superheater to said main steam generator to supply heat to said main steam generator during startup.

12. A startup system for a power plant, said power plant including a main steam generator, first and second turbines and a reheater connected between said turbines, said startup system including an auxiliary generator and an auxiliary superheater connected to said auxiliary generator, passage means for passing steam from said reheater during startup to said auxiliary superheater to heat a fluid in said auxiliary superheater, and passage means for passing said heated fluid from said auxiliary superheater to said main steam generator to supply heat to said main steam generator during startup.

* * * * *